US008562292B2

(12) United States Patent
Burdgick et al.

(10) Patent No.: US 8,562,292 B2
(45) Date of Patent: Oct. 22, 2013

(54) STEAM TURBINE SINGLET INTERFACE FOR MARGIN STAGE NOZZLES WITH PINNED OR BOLTED INNER RING

(75) Inventors: Steven Sebastian Burdgick, Schenectady, NY (US); Dominick Joseph Werther, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 461 days.

(21) Appl. No.: 12/958,807

(22) Filed: Dec. 2, 2010

(65) Prior Publication Data

US 2012/0141260 A1 Jun. 7, 2012

(51) Int. Cl.
*F01D 9/02* (2006.01)

(52) U.S. Cl.
USPC ..... 415/189; 415/191; 415/209.2; 415/209.4; 415/210.4

(58) Field of Classification Search
USPC ..... 415/182.1, 185, 189, 190, 191, 208.2, 415/209.2, 209.4, 210.1; 29/889.21, 29/889.22; 416/215, 216
See application file for complete search history.

(56) References Cited

U.S. PATENT DOCUMENTS

| | | | | |
|---|---|---|---|---|
| 7,427,187 | B2 | 9/2008 | Burdgick et al. | |
| 7,654,794 | B2 | 2/2010 | Burdgick et al. | |
| 2007/0110575 | A1 * | 5/2007 | Burdgick et al. | 415/209.2 |
| 2007/0292266 | A1 | 12/2007 | Burdgick et al. | |
| 2010/0232934 | A1 | 9/2010 | Burdgick et al. | |

FOREIGN PATENT DOCUMENTS

| | | |
|---|---|---|
| EP | 1898053 A2 | 8/2007 |

* cited by examiner

*Primary Examiner* — Edward Look
*Assistant Examiner* — Maxime Adjagbe
(74) *Attorney, Agent, or Firm* — Ernest G. Cusick; Frank A. Landgraff

(57) ABSTRACT

A steam turbine singlet nozzle airfoil with integral outer sidewall is engaged with an inner ring and an outer ring in a nozzle assembly. The interface of the outer sidewall with the outer ring may include a plurality of mechanical hooks on one or both of the upstream face and the outer radial face of the outer sidewall that engage with complimentary structures on the outer ring. The outer interface may further include low energy welds along limited distances of one or both of the upstream or downstream interface of the outer sidewall and the outer ring. An inner radial end of the singlet nozzle airfoil is pinned into position and fastened to the inner ring. Without a need for high heat welds, distortion of the airfoil and the steam flow path and the associated rework is eliminated and stage performance is improved.

17 Claims, 10 Drawing Sheets

STEAM TURBINE SINGLET INTERFACE FOR MARGIN STAGE NOZZLES WITH PINNED OR BOLTED INNER RING

BACKGROUND OF THE INVENTION

The invention relates generally to steam turbines and more specifically to the arrangement of final stages of nozzle assemblies in the steam turbines with Singlet nozzle airfoils.

Steam turbines typically include static nozzle segments that direct the flow of steam into rotating buckets that are connected to a rotor. In steam turbines, the nozzle, including the airfoil construction, is typically called a nozzle assembly or diaphragm stage. Conventional diaphragm stages are constructed principally using one of two methods. A first method uses a band/ring construction wherein the airfoils are first welded between inner and outer bands extending circumferentially about 180 degrees. Those arcuate bands with welded airfoils are then assembled, i.e., welded between the inner and outer rings of the stator nozzle assembly of the turbine. The second method often consists of airfoils welded directly to inner and outer rings using a fillet weld at the interface. The latter method is typically used for larger airfoils where access for creating the weld is available and band construction is impractical There are inherent limitations using the band/ring method of assembly. A principle limitation in the band/ring assembly method is the inherent weld distortion of the flowpath, i.e., between adjacent airfoils and the steam path sidewalls. The weld used for these assemblies is of considerable size and heat input. That is, the weld requires high heat input using a significant quantity of metal filler. Alternatively, the welds are very deep electron beam welds without filler metal. This material or heat input causes the flow path to distort e.g., material shrinkage causes the airfoils to bow out of their designed shaped in the flow path. In many cases, the airfoils require adjustment after welding and stress relief. The result of this steam path distortion is reduced stator efficiency. The surface profiles of the inner and outer bands can also change as a result of welding the nozzles into the stator assembly further causing an irregular flow path. The nozzles and bands thus generally bend and distort. This requires substantial finishing of the nozzle configuration to bring it into design criteria. In many cases, approximately 30% of the costs of the overall construction of the nozzle assembly is for restoration from the deformation of the nozzle assembly, after welding and stress relief, back to its design configuration.

Also, methods of assembly using single unshrouded airfoil construction welded into rings do not have determined weld depth, lack assembly alignment features on both the inner and outer ring, and also lack retention features in the event of a weld failure. These fillet-welded airfoils also have significant distortion issues as described previously for the band construction. Further, current nozzle assemblies and designs do not have common features between nozzle sizes that enable repeatable fixturing processes. That is, the nozzle assemblies do not have a feature common to all nozzle sizes for reference by machine control tools and without that feature each nozzle assembly size requires specific setup, preprocessing, and specific tooling with consequent increase costs. Accordingly, there has been demonstrated a need for an improved steam flowpath for a stator nozzle which includes low input heat welds to minimize or eliminate steam path distortion resultant from welding processes as well as to improve production and cycle costs by adding features that assist in assembly procedures, machining fixturing, facilitate alignment of the nozzle assembly in the stator and create a mechanical lock to prevent downstream movement of the nozzle assembly in the event of a weld failure.

The last few of stages of diaphragms in a steam turbine are typically called fillet fabrications (FF). The FF construction includes unshrouded airfoils (nozzles) welded to an outer and inner ring. The assembly is sometimes done with a costly and complex fixture, or done using scribed lines and no fixture. Both cases use a large weld fillet at the airfoil to sidewall interface to achieve required weld strength. One of the issues with this type of construction is the amount of weld distortion during fabrication. Another issue is the cycle time (labor hours) required to do the set-up, welding and possible area adjustments after fabrication. Most of these last stages are also very large and require lifting assistance due to the weight of the airfoils.

Accordingly, it would be desirable to provide such fillet construction diaphragms and techniques for fabricating such components with reduced cycle time and reduced weld distortion. Additionally, it would be desirable to improve turbine performance through improved airfoil tolerances and throat control.

BRIEF DESCRIPTION OF THE INVENTION

The present invention relates to nozzle assemblies for turbines and further relates to arrangements and methods for assembling nozzle airfoils to inner and outer rings. Briefly in accordance with one aspect of the present invention, a nozzle assembly is provided for a turbine. The nozzle assembly includes one or more nozzle airfoils, each with an integral outer sidewall. The nozzle assembly also includes an inner ring and an outer ring where the nozzle airfoil extends essentially radially between the inner ring and the outer ring. An inner surface of the outer ring engages with an outer surface of the outer sidewall in a mechanical fit connection, restraining axial motion of the nozzle airfoil. The outer ring further engages in a mechanical fit connection with an upstream face of the outer sidewall, restraining radial motion of the nozzle airfoil. The nozzle airfoil is pinned to the inner ring with at least one fastener. The interface between the outer sidewall and the outer ring may further include a low energy weld at a downstream location.

Another aspect of the present invention provides a method for assembling a steam turbine. The method includes providing an annular outer inner ring and an annular inner ring, where the outer ring includes a male projection or a female recess on each of a radial inner surface and on a tangential downstream surface. Also provided are at least one nozzle airfoil with integral outer sidewall, where the outer sidewall includes a female recess or a male projection on each of a radial outer surface and on a tangential upstream surface, where the female recess or male projection are complimentary to the male projection or female recess of the outer ring and engage therewith. The nozzle airfoil is installed with the integral outer sidewall disposed between the outer ring and the inner ring by one of tangential entry and axial swing entry, engaging the at least one complimentary female recess and male projection of the outer sidewall with the at least one male projection and female recess of the outer ring. The at least one nozzle airfoil is rotatably coupled to the inner ring with at least one fastener that are each inserted into at least one circumferentially-spaced bore extending substantially radially through the inner ring and oriented towards the outer ring such that the at least one nozzle airfoil extends substantially radially outward from the inner ring. The at least one nozzle airfoil is adjusted into a final nozzle position, limiting rotational movement. The at least one nozzle airfoil is coupled to the inner ring with a second plurality of fasteners.

A further aspect of the present invention provides a steam turbine including a nozzle assembly. The nozzle assembly concentrically includes a radially outer ring configured to extend substantially circumferentially within the steam turbine and a radially inner ring configured to extend substantially circumferentially within the steam turbine. The nozzle assembly further includes at least one nozzle airfoil with an integral outer sidewall extending substantially radially between the inner ring and the outer ring. The inner ring includes a plurality of circumferentially-spaced bores extending substantially radially through the inner ring towards the outer ring, some of the plurality of bores each comprise a countersunk portion. At least one nozzle blade is rotatably coupled to the radially inner ring with at least one fastener. One fastener may facilitate orienting the at least one nozzle blade relative to the inner ring. The at least one nozzle airfoil may be coupled to the radially inner ring with a second fastener. A mechanically restrained interface is provided in the radial and axial directions between the outer sidewall of the nozzle airfoil and the outer ring. The mechanically restrained interface may be supplemented or supplanted by low heat welds between the outer sidewall of the nozzle airfoil and the outer ring.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including providing an arrangement and method for fabrication of margin stage nozzle assemblies that require little or no welding, thereby reducing weld distortion effects. With reduced or avoided weld distortion turbine performance is increased through improved airfoil profiles and throat area control. The arrangement further simplifies the construction and improves cycle times for margin stage nozzles. With the limited or unwelded configurations, avoidance of need for post-weld adjustment and simplified construction, the costs for the nozzles will also be lowered.

Figure 1:
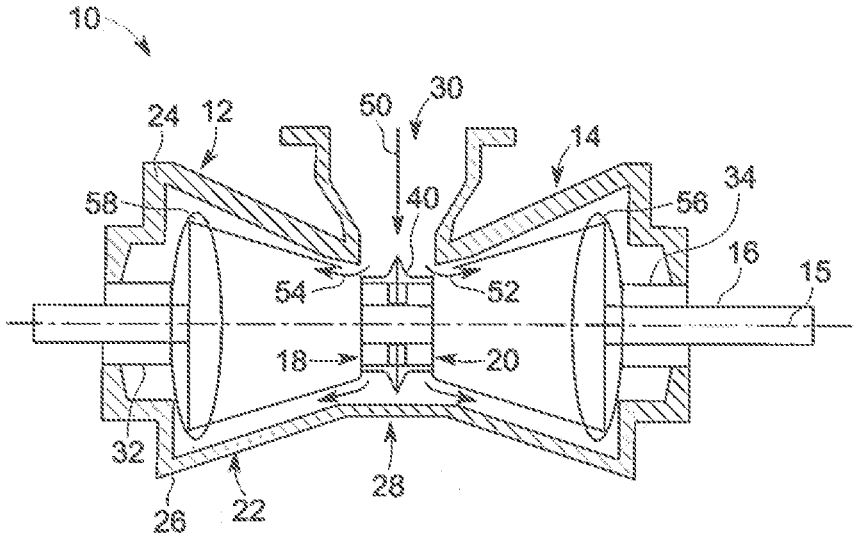
FIG. 1 schematically illustrates an exemplary known opposed flow steam turbine.

FIG. 1 is a schematic illustration of an exemplary opposed-flow steam turbine 10 that may include nozzle assembly configurations of the present invention. Turbine 10 includes first and second low-pressure (LP) sections 12 and 14. Each turbine section 12 and 14 includes a plurality of stages of nozzle assemblies (not shown in FIG. 1). A rotor shaft 16 extends through sections 12 and 14 along radial centerline 15. Each LP section 12 and 14 includes a nozzle 18 and 20. A single outer shell or casing 22 is divided along a horizontal plane and axially into upper and lower half sections 24 and 26, respectively, and spans both LP sections 12 and 14. A central section 28 of shell 22 includes a low-pressure steam inlet 30. Within outer shell or casing 22, LP sections 12 and 14 are arranged in a single bearing span supported by journal bearings 32 and 34. A flow splitter 40 extends between first and second turbine sections 12 and 14. Although FIG. 1 illustrates a double-flow low-pressure turbine, as will be appreciated by one of ordinary skill in the art, the present invention is not limited to being used with low-pressure turbines and can be used with any double-flow turbine including, but not limited to intermediate-pressure (IP) turbines or high-pressure (HP) turbines. In addition, the present invention is not limited to being used with double-flow turbines, but rather may be used with single-flow steam turbines as well, for example.

During operation, low-pressure steam inlet 30 receives low-pressure/intermediate temperature steam 50 from a source, for example, an HP turbine or IP turbine through a cross-over pipe (not shown). The steam 50 is channeled through inlet 30 wherein flow splitter 40 splits the steam flow into two opposite flow paths 52 and 54. More specifically, the steam 50 is routed through LP sections 12 and 14 wherein work is extracted from the steam to rotate rotor shaft 16. The latter stages 52, 54 in the steam flow path may be called margin stages and include the inventive nozzle assemblies (not shown). The steam exits LP sections 12 and 14 and is routed, for example, to a condenser or other heat sink (not shown).

Figure 2:
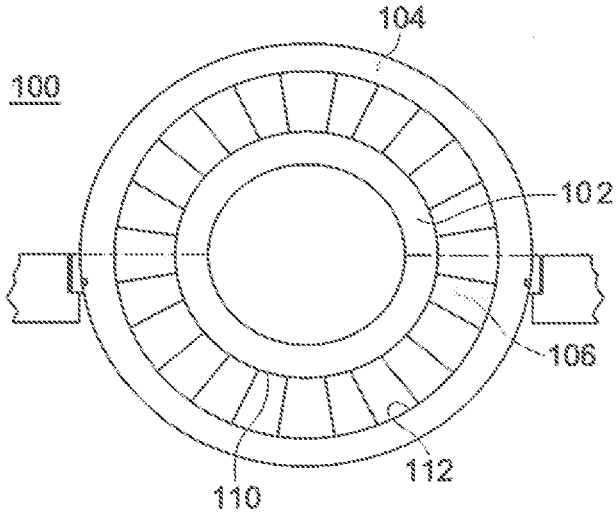
FIG. 2 schematically illustrates an exemplary nozzle assembly that may be used with the steam turbine illustrated in FIG. 1.

FIG. 2 is an enlarged schematic front view of an exemplary nozzle assembly 100 that may be used with steam turbine 10 (shown in FIG. 1). In one embodiment, nozzle assembly 100 is a last stage nozzle assembly of turbine 10. Nozzle assembly 100 includes an annular inner web or ring 102, an annular outer ring 104, and a plurality of nozzle blades or airfoils 106 extending there-between. Outer ring 104 is radially outward of, and substantially concentrically aligned with, inner ring 102. Nozzles 106 are spaced circumferentially between rings 102 and 104 and each extends substantially radially between inner and outer rings 102 and 104, respectively. A radially outer surface 110 of inner ring 102 and a radially inner surface 112 of outer ring 104 define radially inner and radially outer boundaries of a flowpath defined through nozzle assembly 100.

According to an aspect of an embodiment for the inventive nozzle assembly arrangement, a nozzle airfoil with an integral outer sidewall is provided. The nozzle airfoil is provided with a hooked mechanical fit between the integral outer sidewall and an outer ring. The nozzle airfoil is directly fastened on an inner end through a radial bolted and/or pinned fit to an inner ring. The interface between the outer sidewall and the outer ring may include a forward hook and axial hook for a mechanical fit. Additionally a weld at a downstream interface may supplement or supplant the mechanical fit. Here, low heat input welds would be employed, resulting in negligible distortion after welding.

Figure 3:
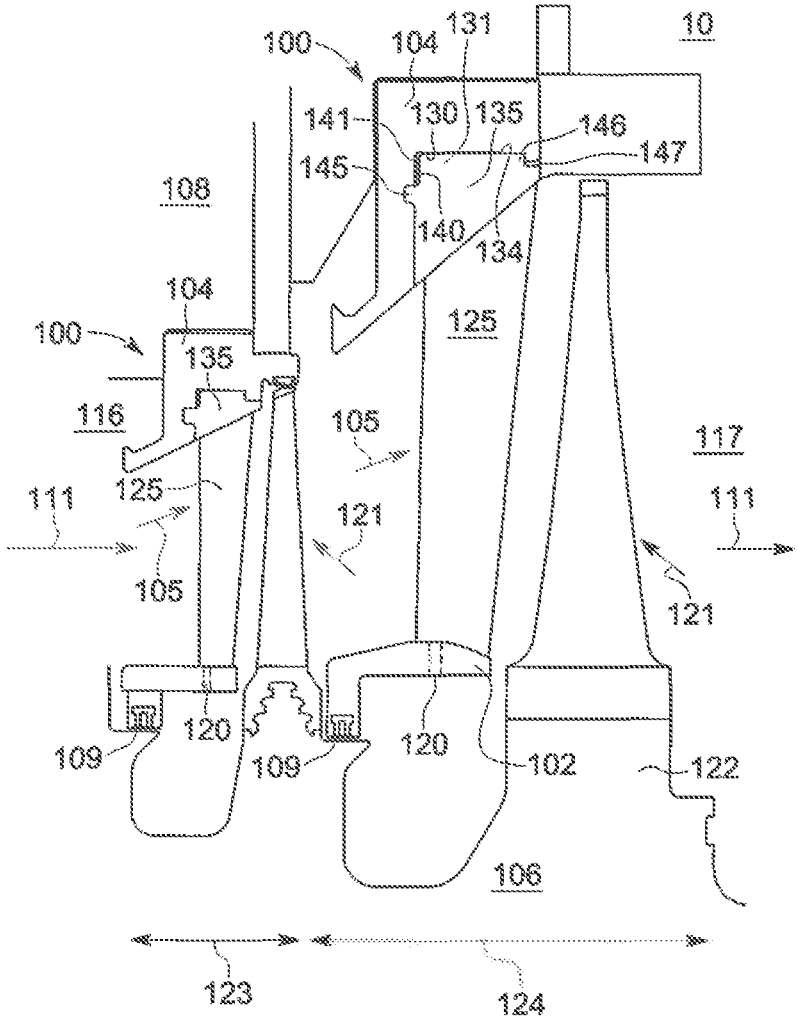
FIG. 3 provides an embodiment for the inventive arrangement for nozzle assemblies within stages of a steam turbine.

FIG. 3 provides an embodiment for the inventive arrangement for nozzle assemblies 100 within stages 123, 124 of a steam turbine 10. An axial view of the two stages of the steam turbine 10 is shown, where each stage includes a nozzle airfoil 125 and a rotor blade 121 with a steam flow path 111 from an upstream space 116 to a downstream space 117. The rotor blade 121 is mounted to rotor wheel 122 (a portion shown). The nozzle assemblies 100 include a nozzle airfoil 125 with integral outer sidewall 135. SINGLET® nozzle technology is a registered trademark of General Electric Co. and will be referred to herein as "Singlet". GE Singlet nozzle technology is employed on the outer sidewall interface to mount the integral sidewall 135 of the nozzle airfoil 125 with the outer ring by a mechanical fit and a pinned nozzle blade technique is used on the inner ring. The outer sidewall 135 may include projections and recesses on each of an outer radial surface and an upstream facing surface that interface with complimentary structures on the outer ring 104. The arrangement for the inner ring provides bolts and/or pins of a simplified representation for a pinned interface 120 to attach the nozzle airfoil 125 to the inner ring 102 in a radial direction. Pinning the airfoil to the inner ring enhances design of the nozzle system by making vibration frequency of the airfoil determinate. The inner ring 102 may also include a seal 109 at rotor 122 to prevent inter-stage steam leakage. The inventive nozzle assembly arrangement 100 provides for improved nozzle profile (stage performance) and surface finish while reducing the build cycle time for the stage.

Figure 4:
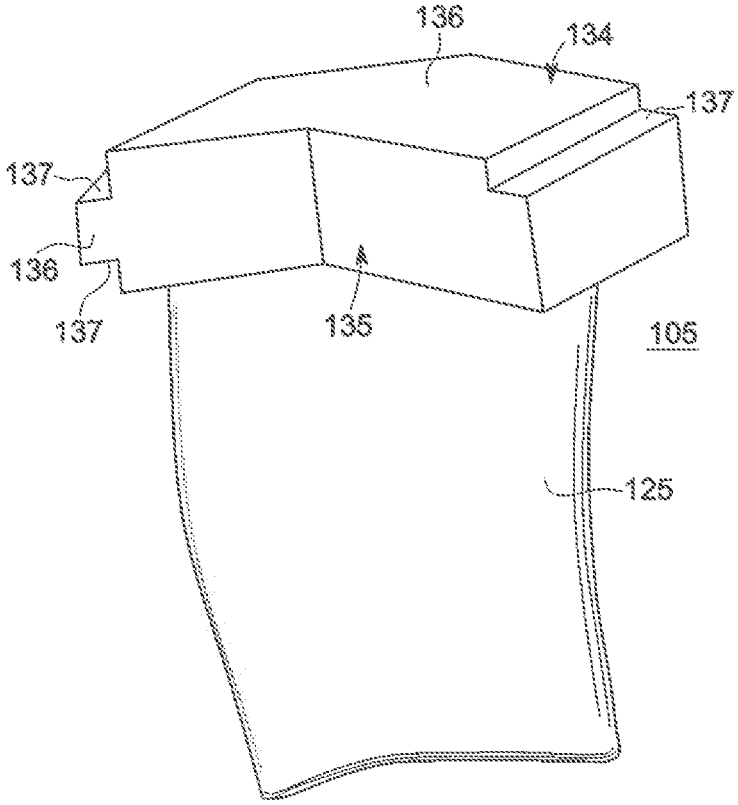
FIG. 4 illustrates an expanded view of an exemplary Singlet nozzle airfoil with an integral outer sidewall.
Figure 5:
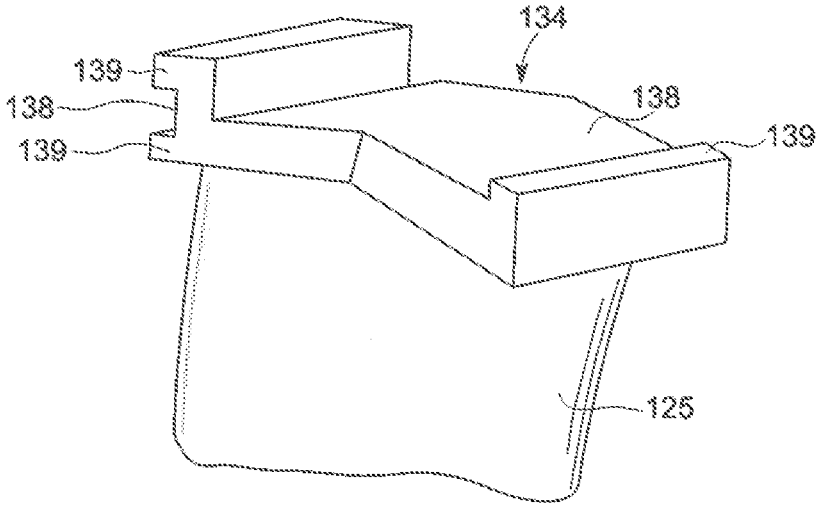
FIG. 5 illustrates an expanded view of an exemplary Singlet nozzle airfoil with integral outer sidewall.

FIG. 4 illustrates an expanded view of an exemplary Singlet 105 i.e., a single nozzle airfoil 125 with an integral outer sidewall 135. The single nozzle airfoil 125 with integral outer sidewall 135 may be machined from a near net forging, a casting, or a block of material. An outer radial surface 134 of the outer sidewall 135 may engaged to the outer ring 104 directly with mechanical features providing reliability and risk abatement due to a mechanical lock at the interface between the nozzle and the outer ring. As illustrated, the outer sidewall 135 may include an outward radial male projection 136 between female recesses 137 on both ends. There the outer sidewall also may include a center male projection 136 straddled by two recesses 137. FIG. 5 illustrates an expanded view of an exemplary Singlet 105. Here, outer radial surface 134 of the outer sidewall 135 of the Singlet 105 includes an inward radial female recess 138 flanked or straddled by radially outward male projections 139. The outer radial surface of the outer sidewall 135 may engage with complimentary female recesses and male projections on an inner radial surface of the outer ring (not shown) to provide axial support for the nozzle airfoil. The outer radial sidewall may also include recess on 138 on upstream face.

Figure 6:
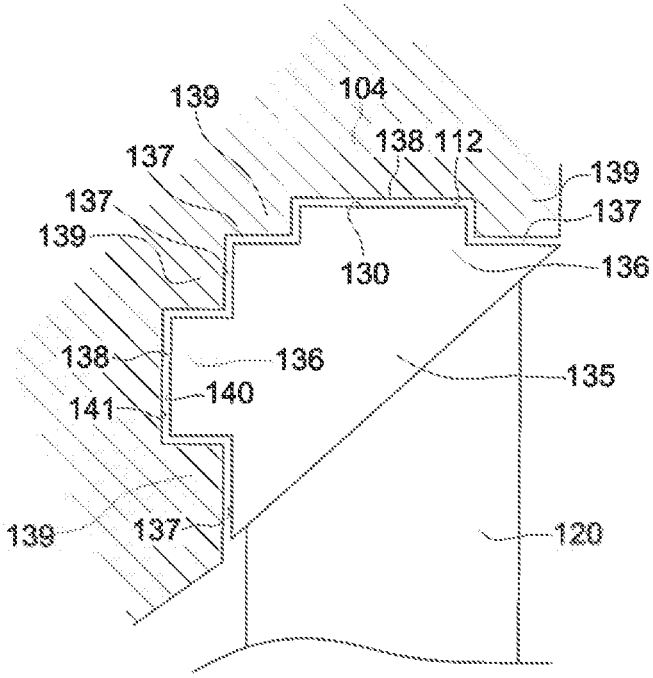
FIG. 6 illustrates an embodiment for mechanical interfaces between an outer radial surface and an upstream surface of the outer sidewall and the outer ring for an exemplary Singlet nozzle airfoil with integral outer sidewall.

In FIGS. 5 and 6, the mechanical interfaces between the outer sidewall 135 of the Singlet nozzle airfoil 125 and the outer ring (not shown) may further include a male projection 136 straddled by female recesses 137 or a female recess 138 straddled by male projections 139 on an upstream facing surface 140 of the outer sidewall 135 that may engage with a complimentary female recess straddled by a male projection; or a male projection straddled by female recesses of a downstream facing surface of the outer ring (not shown). Such additional combinations of mechanical interfaces between the outer sidewall and the outer ring are illustrated in FIGS. 6-9.

Figure 7:
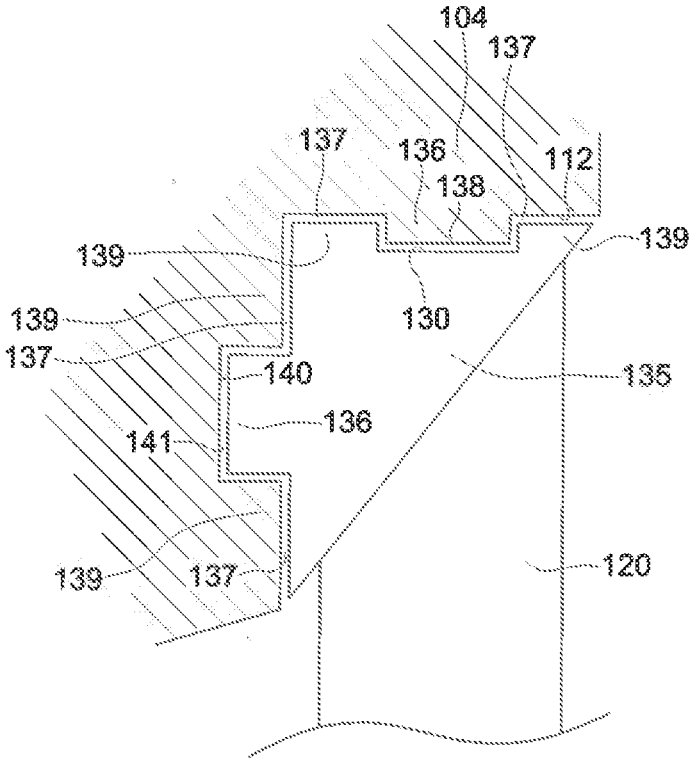
FIG. 7 illustrates another embodiment for mechanical interfaces between an outer radial surface and an upstream surface of the outer sidewall and the outer ring for an exemplary Singlet nozzle airfoil with integral outer sidewall.
Figure 8:
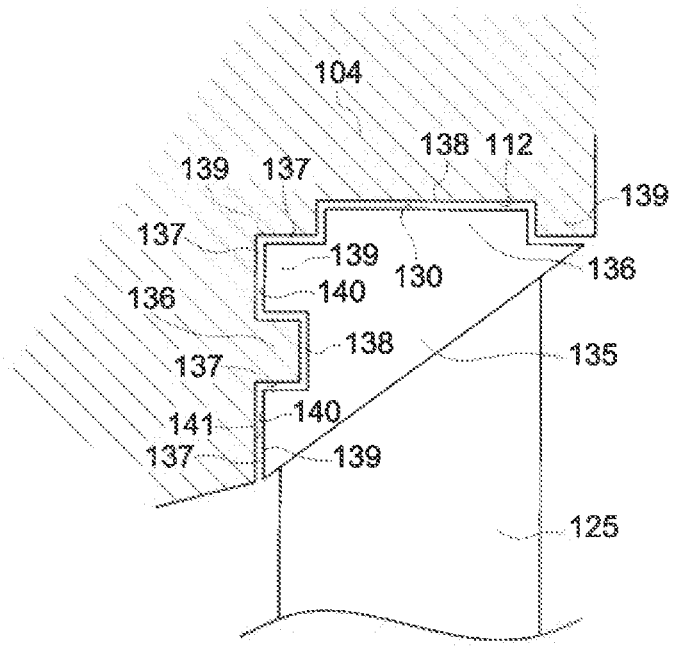
FIG. 8 illustrates a further embodiment for mechanical interfaces between an outer radial surface and an upstream surface of the outer sidewall and the outer ring for an exemplary Singlet nozzle airfoil with integral outer sidewall.
Figure 9:
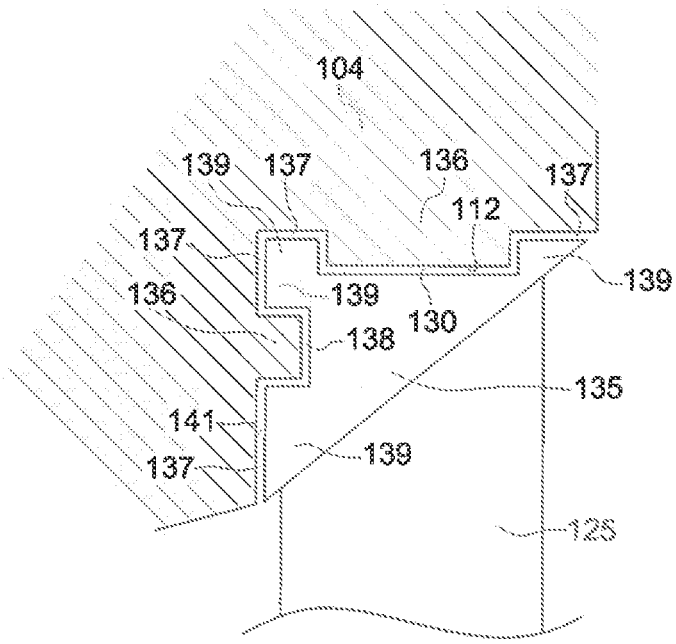
FIG. 9 illustrates yet a further embodiment for mechanical interfaces between an outer radial surface and an upstream surface of the outer sidewall and the outer ring for an exemplary Singlet nozzle airfoil with integral outer sidewall.

FIG. 6 illustrates the engagement of male projections 136 straddled by female recesses 137 on the outer radial surface 130 of outer sidewall 135 with complimentary female recesses 138 straddled by male projections 139 on the inner surface 112 of the outer ring 104. Female recesses 138 are straddled by male projections 139 on the downstream facing surface 141 of the outer ring 104 with complimentary male projections 136 straddled by female recesses 137 on the upstream facing surface 140 of the outer sidewall 135. FIG. 7 illustrates the engagement of center female recess 138 straddled by male projections 139 on the outer radial surface 130 of outer sidewall 135 with complimentary male projection 136 straddled by female recesses 137 on the inner surface 112 of the outer ring 104. A male projection 136 is straddled by female recesses 137 on the upstream facing surface 140 of the outer sidewall 135 with complimentary female recess 138 straddled by male projections 139 on the downstream facing surface 141 of the outer ring 104. FIG. 8 illustrates the engagement of male projection 136 with straddling female recesses 137 on the outer surface 130 of the outer sidewall 135 with complimentary center female recess 138 and straddling male projections 139 on the inner surface 112 of the outer ring 104. Female recess 138 and straddling male projections 139 are disposed on the upstream facing side 140 of the outer sidewall 135 with complimentary center male projection 136 and straddling female recesses 137 on the downstream facing surface 141 of the outer ring 104. FIG. 9 illustrates the engagement of center female recess 138 with straddling male projections 139 on the outer radial surface 130 of the outer sidewall 135 with complimentary center male projection 136 and straddling female recesses 137 on the inner surface 112 of the outer ring 104. Center female recess 138 and straddling male projections 139 are disposed on the upstream facing surface 140 of the outer sidewall 135 with complimentary center male projection 136 and straddling female recesses 137 on the downstream facing surface 141 of the outer ring 104.

Figure 10:
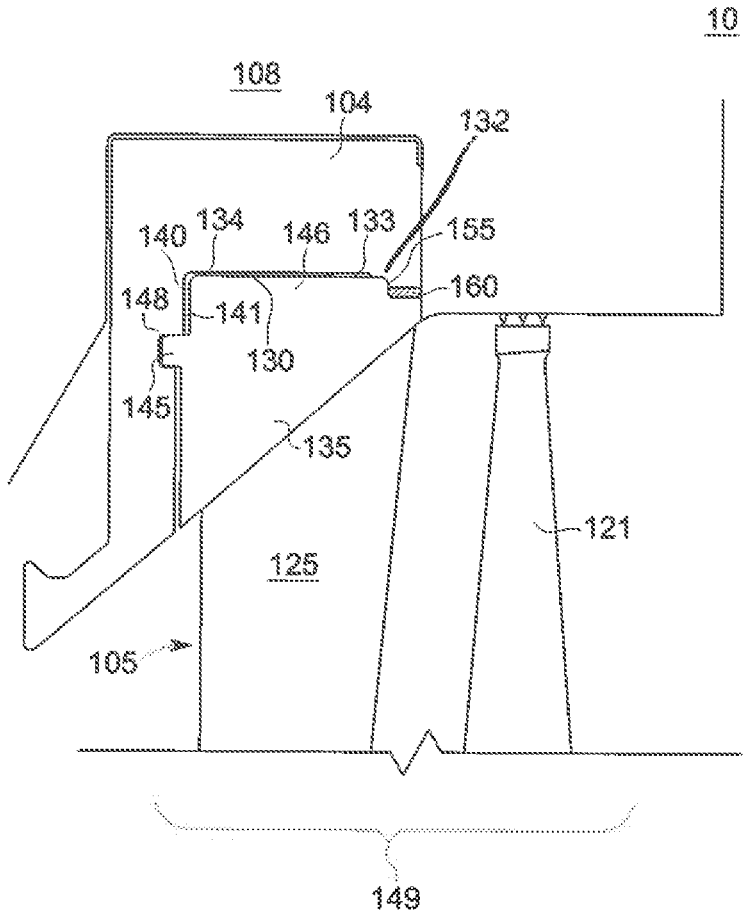
FIG. 10 illustrates an expanded view of an embodiment for an interface of an outer sidewall and outer ring for an exemplary Singlet nozzle airfoil with integral outer sidewall in a stage of a steam turbine.

FIG. 10 illustrates an expanded view of an embodiment for an interface of an outer sidewall 135 and outer ring 104 for an exemplary Singlet nozzle 105 in a stage of a steam turbine 10. The stage 149 includes Singlet nozzle airfoil 125 with integral outer sidewall 135 and rotor blade 121. The outer ring 104 is fixed to turbine casing 108. The outer sidewall 135 includes a forward hook 145 on upstream face of the outer sidewall 135 engaging with recess 148 in downstream surface 140 of the outer ring 104. Axial hook 146 of the outer sidewall 135 engages recess 132 providing an axial stop 155. A low energy weld 160 may also be employed between downstream surface 130 of the outer ring 104 and downstream surface 134 of outer sidewall 135 to restrain axial motion of the Singlet nozzle 105. In the event of a failure of the weld 160, axial stop 155 is available to restrain the Singlet nozzle 105 from downstream release. For example, the low heat input type weld uses a butt weld interface and preferably employs a shallow electron beam weld or shallow laser weld or a shallow flux-TIG (tungsten inert gas) or A-TIG weld process. By using these weld processes and types of welds, the weld is limited to the area between the sidewalls and rings adjacent the steps of the sidewalls. Thus, the welding occurs for only a short axial distance, preferably not exceeding the axial extent of the steps along opposite axial ends of the sidewalls, and without the use of filler weld material.

Figure 11:
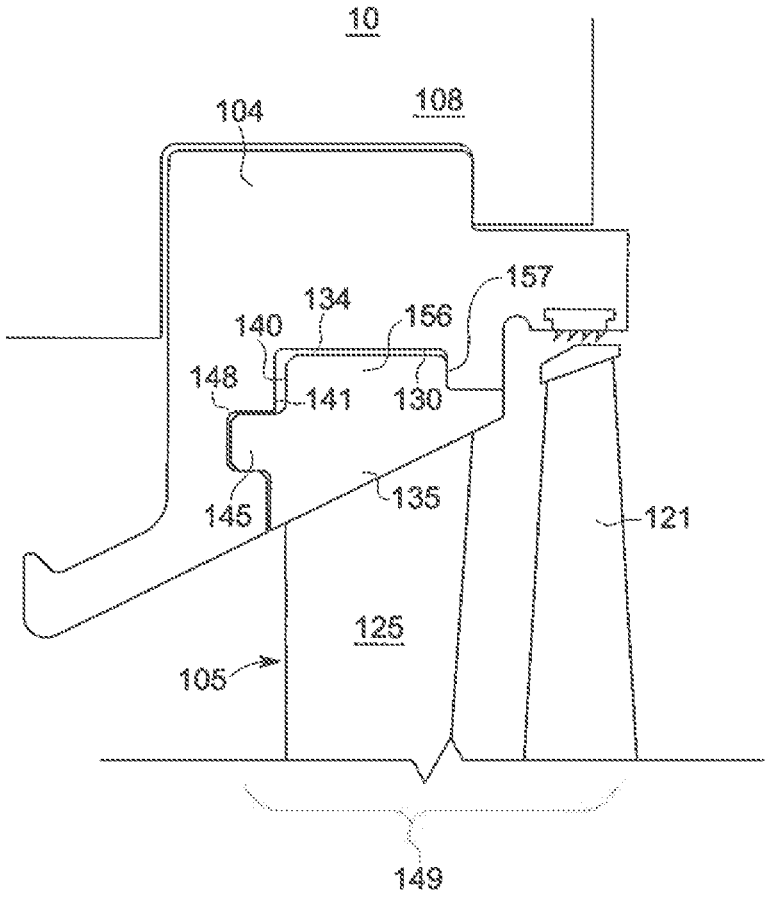
FIG. 11 illustrates an expanded view of another embodiment for an interface of an outer sidewall and outer ring for an exemplary Singlet nozzle airfoil with integral outer sidewall in a stage of a steam turbine.

FIG. 11 illustrates an expanded view of another embodiment for an interface of an outer sidewall 135 and outer ring 104 for an exemplary Singlet 105 in a stage of a steam turbine 10. The stage 149 includes Singlet nozzle 125 with integral outer sidewall 135 and rotor blade 121. The outer ring 104 is fixed to turbine casing 108. The outer sidewall 135 includes a forward hook 145 on upstream face of the outer sidewall 135 engaging with recess 148 in downstream surface 140 of the outer ring 104. Axial hook 146 of the outer sidewall 135 engages recess 132 providing an axial stop 155. The axial hook 156 is this arrangement is larger than the axial hook 146 of FIG. 10. The axial hook 156 will therefore provide a larger engagement with axial stop 157 and by itself will provide sufficient axial restraint on outer sidewall 135, that a downstream weld between the outer surface of the outer sidewall and the inner surface of the outer ring is not needed. This would be a low heat input weld, for example, a gas metal arc weld (GMAW) or a gas tungsten arc weld (GTAW).

Figure 12:
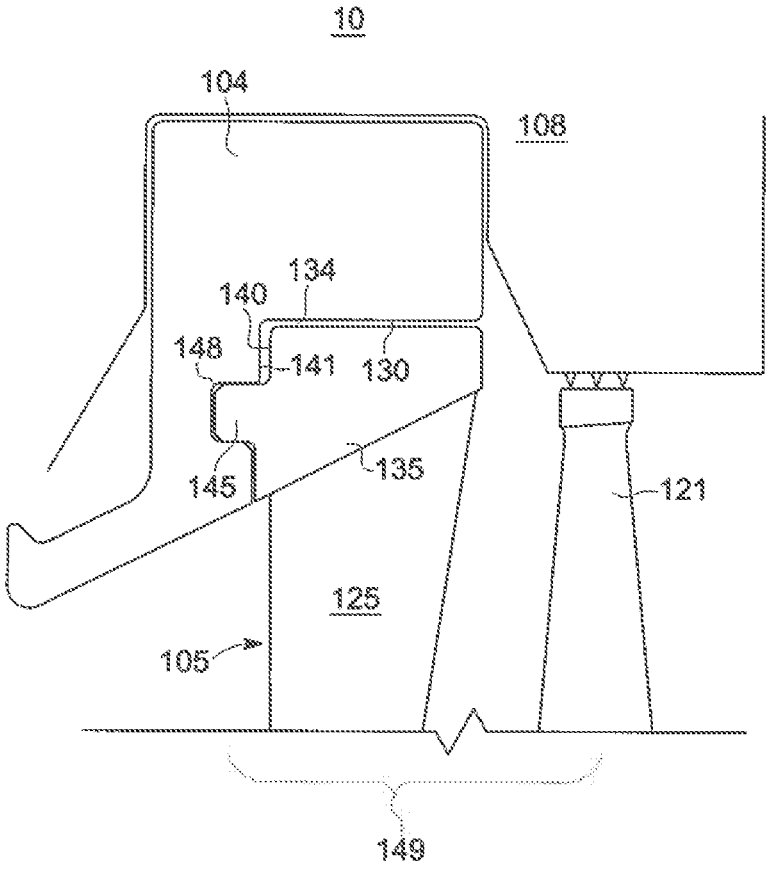
FIG. 12 illustrates an expanded view of still another embodiment for an interface of an outer sidewall and outer ring for an exemplary Singlet nozzle airfoil with integral outer sidewall in a stage of a steam turbine.

FIG. 12 illustrates an expanded view of still another embodiment for an interface of an outer sidewall 135 and outer ring 104 for an exemplary Singlet 105 in a stage of a steam turbine 10. The stage 149 includes Singlet nozzle 125 with integral outer sidewall 135 and rotor blade 121. The outer ring 104 is fixed to turbine casing 108. The outer sidewall 135 includes a forward hook 145 on upstream face of the outer sidewall 135 engaging with recess 148 in downstream surface 140 of the outer ring 104. No axial hook is provided between the outer surface 134 of outer sidewall 135 and inner surface 130 of outer ring 104. Sufficient axial support for retention of the Singlet nozzle against downstream forces is provided by the interface of airfoil 125 with inner ring, as will be described in more detail below.

Figure 13:
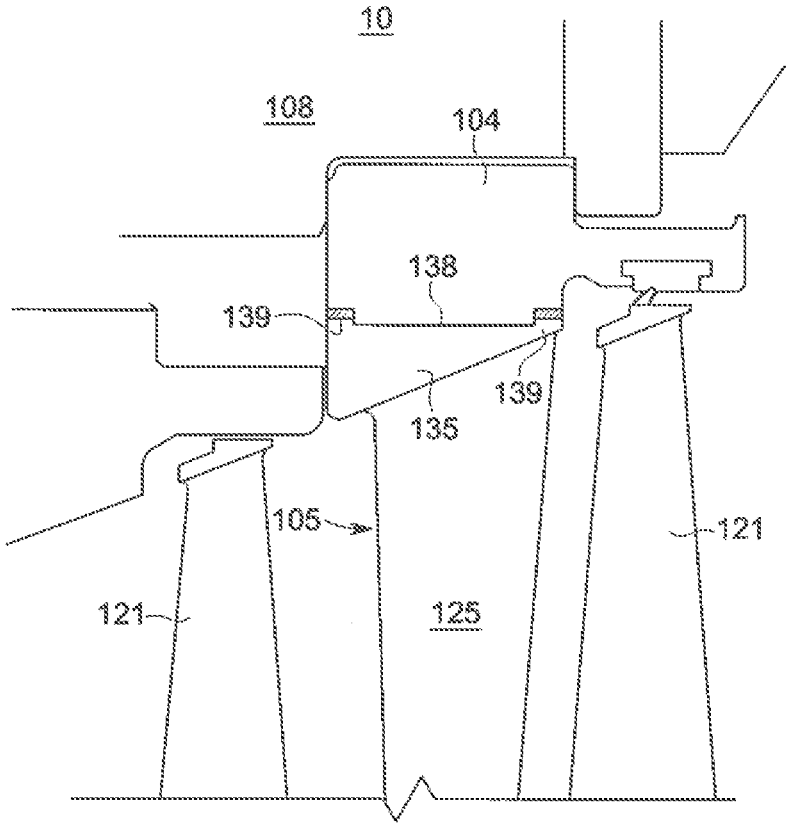
FIG. 13 illustrates a further embodiment of a nozzle assembly including a Singlet nozzle airfoil with integral outer sidewall with mechanical features providing improved reliability and risk abatement due to a mechanical lock at the interface between the nozzle assembly and outer ring.

FIG. 13 illustrates a further embodiment of a nozzle assembly according to the present invention which utilizes a Singlet airfoil with sidewalls welded to outer rings directly with a low heat input weld, and which has mechanical features providing improved reliability and risk abatement due to a mechanical lock at the interface between the nozzle assembly and outer ring. The nozzle assembly may include integrally formed Singlet 105. Each Singlet includes a single airfoil 125, the airfoil and sidewalls being machined from a near net forging or a block of material. The outer sidewall 104 includes a central female recess 138 straddled by male projections 139 where the opposing outer ring 104 includes complimentary structures. Alternatively, the outer sidewall 135 may have a central male projection flanked by radially inwardly extending female recesses along leading and trailing edges of the outer sidewall.

The nozzle Singlets 105 are assembled to outer rings 104, using a low heat input type weld. For example, the low heat input type weld uses a butt weld interface and preferably employs a shallow electron beam weld or shallow laser weld or similar weld process. By using these weld processes and types of welds, the weld is limited to the area between the sidewalls and rings adjacent the steps of the sidewalls or in the region of the steps of the outer rings if the configuration is reversed at the interface from those shown in FIG. 13. Thus, the welding occurs for only a short axial distance, preferably not exceeding the axial extent of the steps along opposite axial ends of the sidewalls, and without the use of filler weld material.

Figure 14:
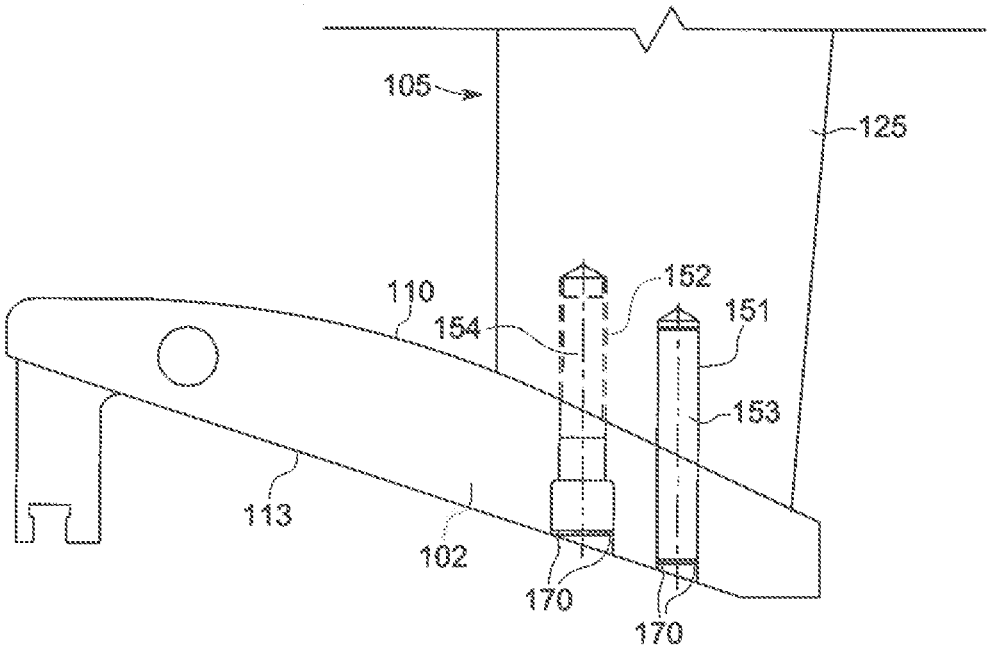
FIG. 14 illustrates an exemplary embodiment of an interface of a Singlet nozzle airfoil and integral outer sidewall to an inner ring.

FIG. 14 illustrates an exemplary embodiment of an interface of a nozzle airfoil and integral outer sidewall to an inner ring. The nozzle assembly inner ring 102 may be fabricated from a rolled or forged ring or barrel or by any means that enables the ring to function as described herein. Ring 102 includes a plurality of alignment openings 151 and a plurality of coupling openings 152. In the exemplary embodiment, openings 151 may be pin openings and openings 152 may be bolt openings, the openings extending generally radially through inner ring 102 between flowpath surface 110 and a radially inner surface 113 of inner ring 102.

Openings 151 and 152 are each spaced circumferentially about inner ring 102. In the exemplary embodiment, openings 151 are spaced axially downstream from openings 152, but the openings 151 may be formed at any location with respect to openings 152 that facilitates assembly of nozzle assembly 100 as described herein. In the exemplary embodiment, alignment openings 151 and coupling openings 152 are drilled using a precision machining process or any process that enables the openings 151 to function as described herein. The location of openings 151 facilitates determining circumferential spacing between circumferentially adjacent airfoils 125 along the inner flowpath. Moreover, the location of openings 151 also facilitates aligning each airfoil 125 axially relative to inner ring 102 and more specifically, relative to flowpath surface 110. The location of openings 112 facilitates determining a throat area defined between circumferentially adjacent airfoils 125. In the exemplary embodiment, openings 152 may be slightly oversized to facilitate accommodating slight alignment modifications while setting individual throat areas. During fabrication of nozzle assembly 100, initially openings 111 and 112 are formed generally radially within inner ring 102. A first airfoil 125 is then positioned relative to inner ring flowpath surface 110, and an alignment pin 153 is slidably received within a respective alignment opening 111. More specifically, alignment pin 153 is inserted generally radially from inner surface 114, through inner ring 102, and into the airfoil 125 positioned against flowpath surface 110. Each pin 153 is received in a friction fit within a respective opening 111. Pins 153 facilitate positioning airfoils 125 both circumferentially with respect to each other, as well as axially with respect to inner ring flow path surface 110. Alternatively, a plurality of pins 153 may be used to facilitate aligning each airfoil 125 with respect to every other airfoil.

Airfoils 125 are then oriented with respect to nozzle assembly 100 and coupling openings 112 are then formed within inner ring 102 and within airfoils 125. In the exemplary embodiment, the portion of openings 112 defined within airfoils 124 is threaded. Each coupling bolt 154 is then inserted within each opening 152 to facilitate securing each airfoil 125 to inner ring 102. More specifically, even as bolts 154 are threadably coupled within each airfoil 125, an orientation of airfoils 125 may still be rotated slightly to adjust individual nozzle throat areas. In an alternative embodiment, a plurality of bolts 154 are used to facilitate securing each airfoil 125 to inner ring 102. Following bolting and/or pinning of the inner ring a retaining means 170 is provided to retain the bolt or pin. The retaining means 170 may include a "tack" weld or staking of the bolt and/or pin within the hole.

The above-described coupling of the airfoil 125 to the inner ring 102 may be employed with any of the mechanical interfaces of the outer sidewall 135 of the Singlet 105 with the outer ring 104 (FIGS. 10-13).

While various embodiments are described herein, it will be appreciated from the specification that various combinations of elements, variations or improvements therein may be made, and are within the scope of the invention.

The invention claimed is:

1. A nozzle assembly for a steam turbine comprising:

at least one nozzle airfoil including an integral outer sidewall;

an inner ring and an outer ring wherein the at least one nozzle airfoil extends essentially radially between the inner ring and the outer ring;

an inner surface of the outer ring having a mechanical fit connection with an outer surface the outer sidewall restraining axial motion of the at least one nozzle airfoil;

the outer ring having a mechanical fit connection with an upstream face of the outer sidewall restraining radial motion of the at least one nozzle airfoil; and the at least one nozzle airfoil pinned to the inner ring with a plurality of fasteners; and wherein the mechanical fit connection between the outer ring and the outer sidewall comprising one of:

a radially inward male projection disposed along an inner radial surface of the outer ring, complimentary to a radially inwardly extending female recess disposed on an outer radial surface of the outer sidewall; and a radially outward extending female recess disposed along an inner radial surface of the outer ring, complimentary to a radially outward male projection disposed along an outer surface of the outer sidewall, and further wherein the mechanical fit connection between the outer ring and the outer sidewall further comprising one of:

a male projection extending axially downstream disposed on an axially downstream surface of the outer ring, and a complimentary axially extending female recess disposed on an upstream surface of the outer sidewall; and a female recess extending axially upstream disposed on an axially downstream surface of the outer ring, and a complimentary axial male projection disposed on an upstream surface of the outer sidewall.

2. The nozzle assembly according to claim 1, wherein the pinning of the at least one nozzle airfoil to the inner ring comprises:

the airfoil rotatably coupled to the inner ring with a first plurality of fasteners, wherein the first plurality of fasteners arrange the at least one nozzle airfoil relative to the inner ring, and the at least one nozzle airfoil coupled radially to the inner ring with a second plurality of fasteners.

3. The nozzle assembly according to claim 2, the inner ring comprising a plurality of outward radially oriented bores disposed circumferentially around the inner ring, the plurality of bores including a countersunk arrangement.

4. The nozzle assembly according to claim 3, wherein the first plurality of fasteners includes at least one alignment pin and the second plurality of fasteners includes at least one bolt.

5. The nozzle assembly according to claim 4, wherein the inner rim comprises a plurality of openings therethrough wherein the plurality of openings facilitate aligning the airfoil nozzle on the inner rim.

6. The nozzle assembly according to claim 1, wherein the at least one nozzle airfoil is inserted tangentially between the outer ring and the inner ring.

7. The nozzle assembly according to claim 1, wherein the at least one nozzle airfoil is swung axially into place between the outer ring and the inner ring.

8. The nozzle assembly according to claim 1, wherein the outer sidewall is welded to the outer ring without the addition of weld filler material at a downstream space between the inner radial surface of the outer ring and the outer radial surface of the outer sidewall.

9. The nozzle assembly according to claim 1, wherein the outer sidewall is welded to the outer ring without the addition of weld filler material at at least one of:

a downstream space between the inner radial surface of the outer ring and the outer radial surface of the outer sidewall; and an upstream space between the inner radial surface of the outer ring and the outer radial surface of the outer sidewall.

10. A method for assembling a steam turbine, the method comprising:

providing an annular outer inner ring and an annular inner ring wherein the outer ring includes one of a male projection and a female recess on each of a radial inner surface and on a tangential downstream surface;

providing at least one nozzle airfoil with integral outer sidewall wherein the outer sidewall includes one of a female recess and a male projection on each of an radial outer surface and on a tangential upstream surface, the female recess or male projection being complimentary to the male projection or female recess of the outer ring to define a mechanical fit connection between the outer ring and the outer sidewall, the mechanical fit connection between the outer ring and the outer sidewall comprising one of:

a radially inward male projection disposed along an inner radial surface of the outer ring, complimentary to a radially inwardly extending female recess disposed on an outer radial surface of the outer sidewall; and a radially outward extending female recess disposed along an inner radial surface of the outer ring, complimentary to a radially outward male projection disposed along an outer surface of the outer sidewall, and further wherein the mechanical fit connection between the outer ring and the outer sidewall further comprising one of:

a male projection extending axially downstream disposed on an axially downstream surface of the outer ring, and a complimentary axially extending female recess disposed on an upstream surface of the outer sidewall; and a female recess extending axially upstream disposed on an axially downstream surface of the outer ring, and a complimentary axial male projection disposed on an upstream surface of the outer sidewall;

installing the at least one nozzle airfoil with integral outer sidewall between the outer ring and the inner ring by one of tangential entry and axial swing entry by engaging the at least one complimentary female recess and male projection of the outer sidewall with the at least one male projection and female recess of the outer ring;

rotatably coupling the at least one nozzle airfoil to the inner ring with a first plurality of fasteners that are each inserted into one of a plurality of circumferentially-spaced bores extending substantially radially through the inner ring and oriented towards the outer ring such that the at least one nozzle airfoil extends substantially radially outward from the inner ring; and adjusting the at least one nozzle airfoil into a final nozzle airfoil position; and limiting rotational movement of the at least one nozzle airfoil and coupling each of the plurality of airfoils to the inner ring with a second plurality of fasteners.

11. The method according to claim 10, further comprising at least one of:

welding the outer sidewall to the outer ring on a downstream surface at an interface between the inner radial surface of the outer ring and the outer radial surface of the outer sidewall; and welding the outer sidewall to the outer ring on an upstream surface at an interface between a downstream tangential surface of the outer ring and an upstream tangential surface of the outer sidewall.

12. The method according to claim 10, wherein coupling the at least one nozzle airfoil to the inner ring with a first plurality of fasteners further comprises inserting at least one alignment pin generally radially into each of the at least one nozzle airfoil to facilitate aligning each of the at least one nozzle airfoil with respect to the inner ring.

13. The method according to claim 10 wherein coupling the at least one nozzle airfoil to the inner ring with a second plurality of fasteners further comprises coupling each of the at least one nozzle airfoil to the inner ring with at least one bolt.

14. The method in accordance with claim 10 further comprising forming the plurality of circumferentially-spaced bores within the inner ring such that each of the bores is sized to receive a portion of the first plurality of fasteners therethrough to facilitate securing the at least one nozzle airfoil to the inner ring.

15. A steam turbine comprising a nozzle assembly including:

a radially outer ring configured to extend substantially circumferentially within the steam turbine;

a radially inner ring configured to extend substantially circumferentially within the steam turbine;

at least one nozzle airfoil with integral outer sidewall extending substantially radially between the inner ring and the outer ring;

the inner ring comprising a plurality of circumferentially-spaced bores extending substantially radially through the inner ring towards the outer ring, some of the plurality of bores each comprise a countersunk portion; and the at least one nozzle airfoil rotatably coupled to the radially inner ring with a first plurality of fasteners, the first plurality of fasteners facilitate orienting the at least one nozzle airfoil relative to the inner ring, the at least one nozzle airfoil coupled to the radially inner ring with a second plurality of fasteners; and a mechnically restrained interface between the outer sidewall of the nozzle airfoil and the outer ring; and wherein the mechanically restrained interface between the outer sidewall of the at least one nozzle airfoil and the outer ring comprises:

one of a radially inward male projection disposed along an inner radial surface of the outer ring, complimentary to a radially inwardly extending female recess disposed on an outer radial surface of the outer sidewall; and a radially outward extending female recess disposed along an inner radial surface of the outer ring, complimentary to a radially outward male projection disposed along an outer surface of the outer sidewall; and one of a male projection extending axially downstream disposed on an axially downstream surface of the outer ring, and a complimentary axially extending female recess disposed on an upstream surface of the outer sidewall; and a female recess extending axially upstream disposed on an axially downstream surface of the outer ring, and a complimentary axial male projection disposed on an upstream surface of the outer sidewall.

16. The steam turbine according to claim 15, wherein the outer sidewall is welded to the outer ring without the addition of weld filler material at at least one of:

a downstream space between the inner radial surface of the outer ring and the outer radial surface of the outer sidewall; and an upstream space between the inner radial surface of the outer ring and the outer radial surface of the outer sidewall.

17. The steam turbine according to claim 15, the plurality of circumferentially spaced bores are sized to receive at least a portion of the second plurality of fasteners therethrough for securing the at least one nozzle airfoil within the nozzle assembly, wherein the first plurality of fasteners comprise an alignment pin and the second plurality of fasteners comprises a bolt, the alignment pin facilitates aligning each of the at least one nozzle airfoil within the nozzle assembly, the bolt facilitates securing each of the at least one nozzle airfoil within the nozzle assembly.

* * * * *

UNITED STATES PATENT AND TRADEMARK OFFICE

CERTIFICATE OF CORRECTION

PATENT NO. : 8,562,292 B2
APPLICATION NO. : 12/958807
DATED : October 22, 2013
INVENTOR(S) : Burdgick et al.

It is certified that error appears in the above-identified patent and that said Letters Patent is hereby corrected as shown below:

In the Specification

In Column 7, Line 21, delete "Singlet nozzle 125" and insert -- Singlet nozzle 105 --, therefor.

In Column 7, Line 39, delete "Singlet nozzle 125" and insert -- Singlet nozzle 105 --, therefor.

In the Claims

In Column 12, Line 5, in Claim 15, delete "mechnically" and insert -- mechanically --, therefor.

Signed and Sealed this
Third Day of June, 2014

Michelle K. Lee

Michelle K. Lee
*Deputy Director of the United States Patent and Trademark Office*